United States Patent [19]

Smith

[11] 4,356,852

[45] Nov. 2, 1982

[54] HAND DRIVE TOOL

[75] Inventor: William C. Smith, Barrington, Ill.

[73] Assignee: Innovative Tool Corporation, Houston, Tex.

[21] Appl. No.: 168,548

[22] Filed: Jul. 14, 1980

Related U.S. Application Data

[63] Continuation-in-part of Ser. No. 927,465, Jul. 24, 1978, Pat. No. 4,212,336.

[51] Int. Cl.[3] ..... B25G 1/00

[52] U.S. Cl. ..... 145/61 L; 81/58.1; 81/177 G; 81/437; 145/61 G

[58] Field of Search ..... 145/61 L, 61 G, 61 R; 81/436, 437, 58.1, 177 G

[56] References Cited

U.S. PATENT DOCUMENTS

| | | | |
|---|---|---|---|
| 814,020 | 3/1906 | Clifford | 81/177 G |
| 814,734 | 3/1906 | Schade | 145/61 R |
| 921,840 | 5/1909 | Jacobs | 145/61 R |
| 1,120,334 | 12/1914 | Prokop | 145/61 L |
| 1,761,156 | 6/1930 | Rosan | 81/436 |
| 2,046,733 | 7/1936 | Forsberg | 145/61 R |
| 2,792,094 | 5/1957 | Baldwin et al. | 81/58 |
| 4,099,430 | 7/1978 | Stodola | 81/58.1 |

*Primary Examiner*—Stephen G. Kunin
*Assistant Examiner*—J. T. Zatarga
*Attorney, Agent, or Firm*—Frank S. Vaden, III; Emil J. Bednar

[57] ABSTRACT

An improved hand tool includes a well at the top of the handle into which the upper end of the shank extends. The well is adapted to receive a torque producing socket wrench drive which engages the shank in order to transmit the torque producing drive directly to the tip of the hand drive tool. In the preferred embodiment the shank which extends into a well has a hexagonal cross-section and is adapted to cooperate with a standard socket wrench. Tips of various configuration may be employed.

8 Claims, 6 Drawing Figures

HAND DRIVE TOOL

The present application is a continuation-in-part of copending application Ser. No. 927,465 filed July 24, 1978, now U.S. Pat. No. 4,212,336.

The present invention relates to an improved hand drive tool. More particularly the present invention relates to an improved screwdriver having a well in the top of the handle adapted to engage the drive stud of a conventional socket wrench ratchet or socket wrench drive tool, without in any way interfering with the utility of the screwdriver to perform its ordinary, multiple functions.

The ordinary screwdriver is one of the most useful tools known to man. Mechanisms and craftsmen of various callings employ the screwdriver in many and varied functions, only one of which is the function of turning screws. Screwdrivers are conventionally used as levers to pry open paint cans, and to raise or prop up doors fpr purposes of installing hinges. Further, screwdrivers serve as chisels, picks, electrical grounding devices, scrapers, and in many other functions, not the least of which is the turning of screws, to both insert the screws and to remove them.

In turning screws, there are many occasions when increased torque is required in order to insert a large screw in a small hole or to remove a screw which is difficult to turn by reason of rust or other similar conditions. The torque which can be manually put on a screw using a handriven conventional screwdriver, is limited and is ultimately depending upon the diameter of the handle of the screwdriver and the strength of the hand of the person using the screwdriver. Unfortunately, the human wrist is constructed in such a manner that an increased effort to turn the handle of the screwdriver will frequently cause irritation to the hand with the attendant formation of blisters and/or cause the screwdriver to move off center which, in turn, may cause the screwdriver blande to slip from the slot of the screw head, whereupon the screwdriver blade frequently damages the kerf or the slot of the screw. Additionally, when the screwdriver slips out of the slot it may embed on the surface being worked or upon the skin of the person using the screwdriver. The resulting damage to the slot of the screw makes it increasingly more difficult to bring sufficient torque to bear on the screw. Thus there is a long felt need in the art for a screwdriver device having provision for increased torque.

In recent years a wide variety of proprietary and special purpose fastener head designs have become available on a commercial basis. Many of the special purpose fasteners have been developed with specific end uses in mind and each of the designs has its own advantages and limitations. One of the principal reasons for the development of the special purpose fastener head is to increase the amount of torque that can be delivered to the fastener. It is known generally that the amount of torque that can be delivered to a fastener is roughly proportional to the area of contact between the fastener and the drive tool. For example, the given fastener size, an externally gripped Torx head can take more load than a drilled spanner. Other fasteners of increased contact area include the well-known Phillips driver, Hi-torque, Hexagon socket, Drilled Spanner, Tri-wing, Torx, Slotted Spanner, Hexagon Tamper proof, Pozidriv, Fluted Socket, Torq-set, Clutch and Frearson.

The prior art has proposed a number of devices which purport to solve this problem and fill this need. The prior art devices include a screwdriver blade adapted to be driven with increased torque which is applied to the head of a screw, e.g., see U.S. Pat. Nos. 1,325,070; 1,450,203; 1,743,505; 2,531,722; and 2,558,158, but all of these prior art devices involve complex structures which interfere with the use of the device as an ordinary screwdriver in functions other than turning screws, as described above.

The present invention is directed to an improved hand-drive tool which is particularly adapted to be used with special purpose and propietary fastener head of the type which provide increased contact area, i.e., Phillips. Torx, and the like. In order to take full advantage of such special purpose fastener heads, the drive tool of the present invention may be used in conjunction with a conventional socket wrench, thereby enabling the user to transmit more torque to the fastener head than would be possible using a standard hand-turned "screwdriver"-type handle. The present invention provides a hand drive tool which is conventional in appearance but which is provided with a well in the top of the handle, into which the tool shank extends, which shank is adapted to engage a socket wrench and preferably a socket wrench with a ratchet capability.

The advantages of the present invention, which reside in the details of the construction, will be more fully understood by reference to the accompanying drawings, in which.

Figure 1:
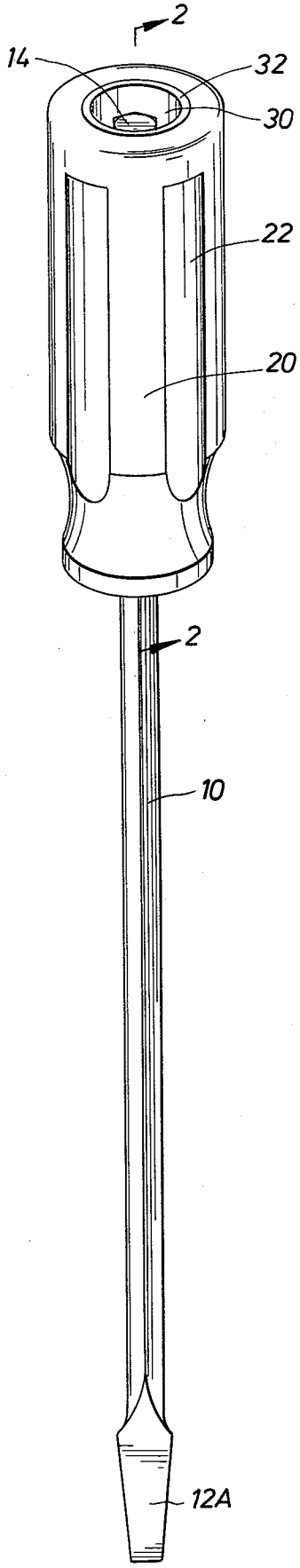
FIG. 1 is an isometric view of the improved hand drive tool of the present invention showing the well in the upper portion of the handle and a standard screw driver tip.
Figure 4:
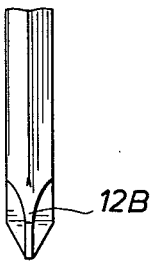
FIG. 4 is a partial side view showing a Phillips tip.
Figure 5:
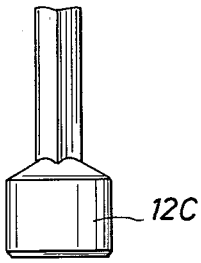
FIG. 5 is a partial side view showing a nut drive type tip.
Figure 6:
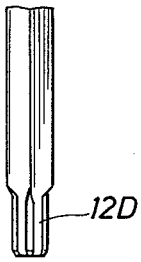
FIG. 6 is a partial side view showing a Torx-type tip.

Referring to the drawings, and particularly to FIG. 1, the improved hand drive tool of the present invention generally comprises a shank 10 and a handle 20. The shank 10 includes a tip 12 at the lower end, adapted to engage fasteners of various types. Tip 12 may either be a conventional style blade as shown as tip 12A of FIG. 1, or a tip designed for Phillips head screw shown in FIG. 4, or a nut drive type tip shown in FIG. 5, or a Torx-type tip shown in FIG. 6. Those skilled in the art will understand that other types of drive tips may be similarly employed.

The shank 10 may be of any size or shape, but advantageously is of square cross-section or hexagonal cross-section. The hexagonal cross-section is preferred, because it more readily engages socket wrenches of different configurations. Conventional screwdrivers, about 8 inches in length, conventionally have a shank formed from steel having square cross-section, but approximately ¼ inch per side. Such a size is useful for hand drive tools of the present invention, but the hexagonal cross-section is preferred. The present invention also contemplates the use of shanks having a circular cross-section, wherein the upper end is machined or otherwise fabricated to have a polygonal cross-section suitable for engagement by a socket wrench. It is essential that the shank be fabricated from a high tensile steel so that the tip portion is able to withstand the increased torque developed by the improved drive tool of the present invention, which torque may be required to turn the fastener. Generally the shank is made of hardened steel, such as a molybdenum steel alloy. Because of the high torque which may be developed by the improved hand drive tool of the present invention, brittle or weak alloys are not useful as the shank or driver tip.

Figure 3:
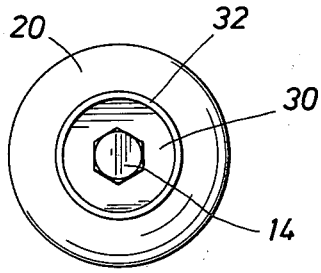
FIG. 3 is a top view of the embodiment shown in FIGS. 1 and 2.

The handle 20 may be of any size or shape or material, but handles of a conventional size and shape, as are shown in the drawings, are preferred. Longitudinal grooves 22, as shown in FIG. 1 (but not FIG. 3), may be positioned about the outer surface of the handle, but are not required. Preferably, the handle is produced from a lightweight plastic material, which may be readily fabricated on an economical basis and which provides a comfortable feeling handle and a screwdriver with a good balance.

In the preferred embodiment, well 30 is lined with sleeve 32, which is cylindrical in shape. Sleeve 32 may be omitted if desired.

Figure 2:
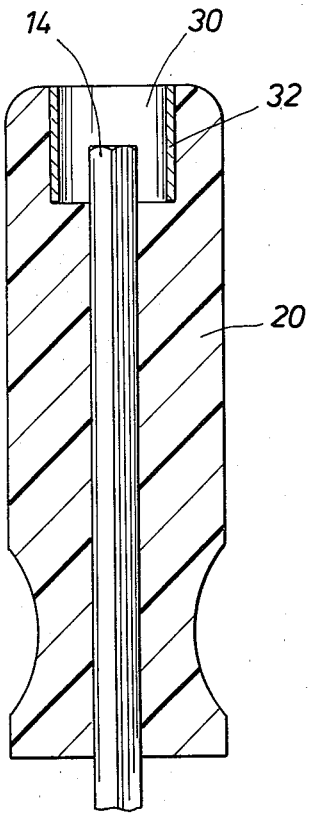
FIG. 2 is a partial side view, taken in vertical section, taken in section at lines 2—2 of FIG. 1, showing the handle of the preferred embodiment of the improved hand drive tool.

As is shown in FIG. 2, in the preferred embodiment the upper portion of shank 14 is located below the upper surface of handle 20. In this embodiment, the user's hand is separated from the upper end of shank 14 and any electrical charge which may be applied to the tip is not transmitted to the user's hand.

Located in the upper portion of the handle 20 is well 30 which may be lined with sleeve member 32. The upper portion of shank 14 extends into well 30 and is positioned coaxially therewith. Well 30 preferably is of circular cross-section and of a size adapted to receive a standard socket wrench and permit the wrench to engage the upper end of shank 14. Conventional socket wrench ratchet may be used to drive the socket wrench which engages the upper end of shank 14.

As illustrated in FIG. 1, the plastic handle 20 includes an opening 30 which is large enough to accommodate a socket wrench, not shown. Opening or well 30 is uncapped and, so as to accommodate the standard socket wrench as described above, has a diameter which is greater than the greatest transverse dimension of the polygonal-shaped cross-section of the one-piece shank such that there is an annular base of the well perpendicular to and surrounding the one-piece shank. Socket wrench may be a conventional socket wrench wherein one end is adapted to engage the drive stud of a $\frac{1}{4}$ inch or $\frac{3}{8}$ inch ratchet, for example, or while the other end may be, for example, a $\frac{1}{4}$ inch 12-point socket or a $\frac{1}{4}$ inch 8-point socket, adapted to engage the upper portion 14 of a square cross-section shank 10. Alternatively, a 12-point socket or a 6-point socket may be used to engage the upper portion 14 of shank 10 when a hexagonal cross-section shank is used. The conventional 12-point socket opening may be used to engage the shank of either a square cross-section or a hexagonal cross-section shank.

Those skilled in the art will appreciate that the hand drive tool of the present invention has many advantages and may be adapted to various forms of usage. For example, the hand drive tool of the present invention is well adapted to applying torque to fasteners wherein there is little or no room adjacent to the handle of the driver, thus making it difficult to grasp the driver. In this case, the socket wrench driving tool enables the user to apply torque to the fastener without the need to grasp the handle of the driver. Further, the hand drive tool of the present invention is adapted to be used with extensions which are customarily used with socket wrench sets, whereby the effective length of the drive tool may be increased with the socket wrench driving tool providing adequate torque to the effectively extended driver. The present invention further provides a tool which may be used by a woman or child to accomplish jobs which could not be accomplished by such a person manually. Thus, the present invention enables a woman to turn fasteners which she simply does not have the strength to turn without the addition of a mechanical lever.

These and other advantages which will be obvious to those skilled in the art are provided by the present invention, without interfering or diminishing in any way from the effectiveness of the tool to carry out the common and varied functions of an ordinary screwdriver. The forms of invention herein shown and described are to be considered only as illustrative. It will be apparent to those skilled in the art that numerous modifications may be made therein without departure from the spirit of the invention or the scope of the appended claims.

I claim:

1. An improved hand drive tool comprising a steel shank and a lightweight plastic handle fixedly secured and surrounding the upper end of said shank for hand-driving said shank, said shank including a tip at the lower end, said tip adapted to engage the head of a fastener and transmit torque to said fastner, a cylindrically shaped opening or well positioned in the upper end of said handle, coaxial with the axis of said shank, said opening or well being large enough to receive the socket of a standard socket wrench, the upper portion of said shank extending into said opening or well, whereby said well is adapted to receive a standard socket wrench in engagement with the upper end of said shank for the application of torque to said shank in addition to that provided by the plastic handle.

2. An improved hand drive tool, as described in claim 1, wherein said shank has a square or a hexagonal cross-section.

3. An improved hand drive tool, as described in claim 2, wherein said tip comprises a Phillips-type tip adapted to engage Phillips head fasteners.

4. An improved hand drive tool, as described in claim 2, wherein said tip comprises a nut-driver type tip adapted to engage nut-type fasteners.

5. An improved hand drive tool, as described in claim 2, wherein said tip comprises a Torx-type tip adapted to engage Torx-type fasteners.

6. An improved hand drive tool, as described in claim 2, wherein said tip comprises a multi-fluted tip adapted to engage a multi-slotted-head fastener.

7. An improved hand drive tool, as defined in claim 2, wherein the upper portion of said shank, which extends into said opening or well, is below the upper surface of the plastic handle.

8. An improved hand drive tool as described in claim 2, wherein the shank which extends into said opening or well has a hexagonal cross-section.

* * * * *